United States Patent [19]

Volf et al.

[11] Patent Number: 4,582,208

[45] Date of Patent: Apr. 15, 1986

[54] SIPHON HEAD

[76] Inventors: Alexander Volf; George Spector, both of 233 Broadway, Rm. 3615, New York, N.Y. 10007

[21] Appl. No.: 656,530

[22] Filed: Oct. 1, 1984

[51] Int. Cl.[4] ..... B65D 41/08

[52] U.S. Cl. ..... 215/274; 285/392; 285/393

[58] Field of Search ..... 215/3, 4, 5, 31, 274, 215/276; 285/392, 393, 357

[56] References Cited

U.S. PATENT DOCUMENTS

| | | | |
|---|---|---|---|
| 327,402 | 9/1885 | Malmstrom et al. | 215/5 |
| 714,092 | 11/1902 | Birchmore | 215/5 |
| 851,459 | 4/1907 | Walter | 215/5 |
| 1,330,327 | 2/1920 | Marshall | 285/392 |
| 1,802,403 | 4/1931 | Campbell | 285/392 X |
| 2,037,220 | 4/1936 | Eugster | 215/5 |
| 2,183,229 | 12/1939 | Soubier | 215/5 |

*Primary Examiner*—Donald F. Norton

[57] ABSTRACT

An adapter for a standard siphon head employed on a threaded neck of a bottle for dispensing carbonated liquids is provided and consists of a collar which has outer threads for installation into the standard siphon head and inner threads for installation onto the threaded neck of the bottle so that the bottle can be emptied of the liquid through the siphon head without further loss of the carbonation. In a modified form the adapter can be designed to be used on various size unthreaded necks of bottles.

3 Claims, 2 Drawing Figures

SIPHON HEAD

BACKGROUND OF THE INVENTION

The instant invention relates generally to siphon heads and more specifically it relates to an adapter for a standard siphon head employed on a bottle for dispensing carbonated liquids.

Numerous siphon heads have been provided in prior art that are adapted to be placed upon bottles to discharge the contents therefrom. For example U.S. Pat. Nos. 327,402; 2,171,373 and 2,183,229 all are illustrative of such prior art. While these units may be suitable for the particular purpose to which they address, they would not be as suitable for the purposes of the present invention as heretofore described.

SUMMARY OF THE INVENTION

An ordinary bottle of carbonated liquid which is sold in a store is initially closed hermetically with a threaded cap. Afterwards during each use of the bottle this cap has to be unscrewed so that a substantial amount of carbonation is lost. After a few times the liquid practically loses all of its carbonation and tastes bad. It is impossible to use a standard siphon head for the bottle because the bottle neck and ends with a standard thread 28 mm in diameter with 8 coils per inch.

The invention allows a person to install the siphon head on the bottle. This is made possible through the use of a special adapter. The adapter has an outer thread which is installed into the siphon head. The adapter also has an inner thread that will engage the threaded neck of the bottle.

A principle object of the present invention is to provide an adapter for a standard siphon head that can be used on ordinary threaded neck bottles of carbonated liquids.

Another object is to provide an adapter for a standard siphon head that can be used on ordinary unthreaded neck bottles of carbonated liquids.

An additional object is to provide an adapter for a standard siphon head that is sealingly adjustable to various size unthreaded neck bottles of carbonated liquids.

A further object is to provide an adapter for a standard siphon head that is simple and easy to use.

A still further object is to provide an adapter for a standard siphon head that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
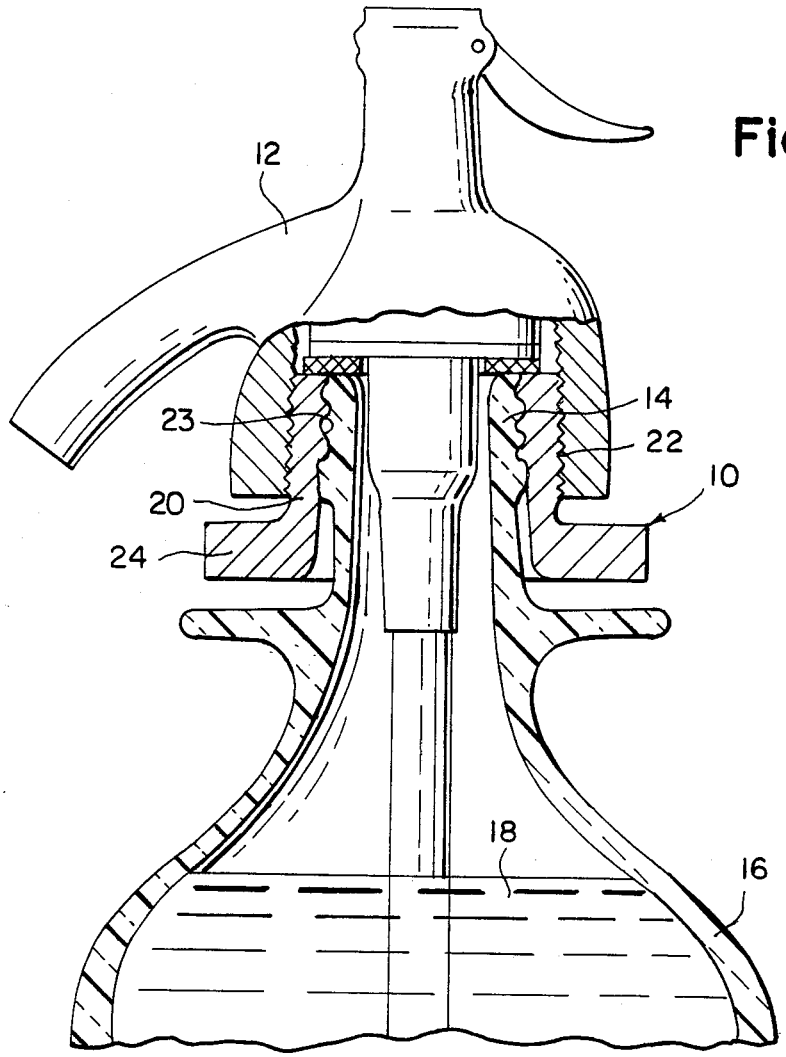
FIG. 1 is a longitudinal section view with parts in elevation of the invention showing a siphon head and adapter on a plastic soda bottle neck, or any threaded glass bottle neck.

Turning now descriptively to the drawings, in which similar reference characters denote similar elements throughout the several views, FIG. 1 illustrates an adapter 10 for a standard siphon head 12 employed on a threaded neck 14 of a bottle 16, such as a soda bottle, for dispensing carbonated liquids 18. The adapter 10 consists of a collar 20 that has outer threads 22 for installation into the standard siphon head 12 and inner threads 24 for installation onto the threaded neck 14 of the bottle 16. The bottle 16 can be emptied of the liquid 18 through the siphon head 12 without further loss of the carbonation.

The collar 20 further contains an annular flange 24 extending outwardly from bottom thereof to aid in manually tightening the collar 20 onto the standard siphon head 12 and the threaded neck 14 of the bottle 16 preventing leakage of the carbonation when installed.

Figure 2:
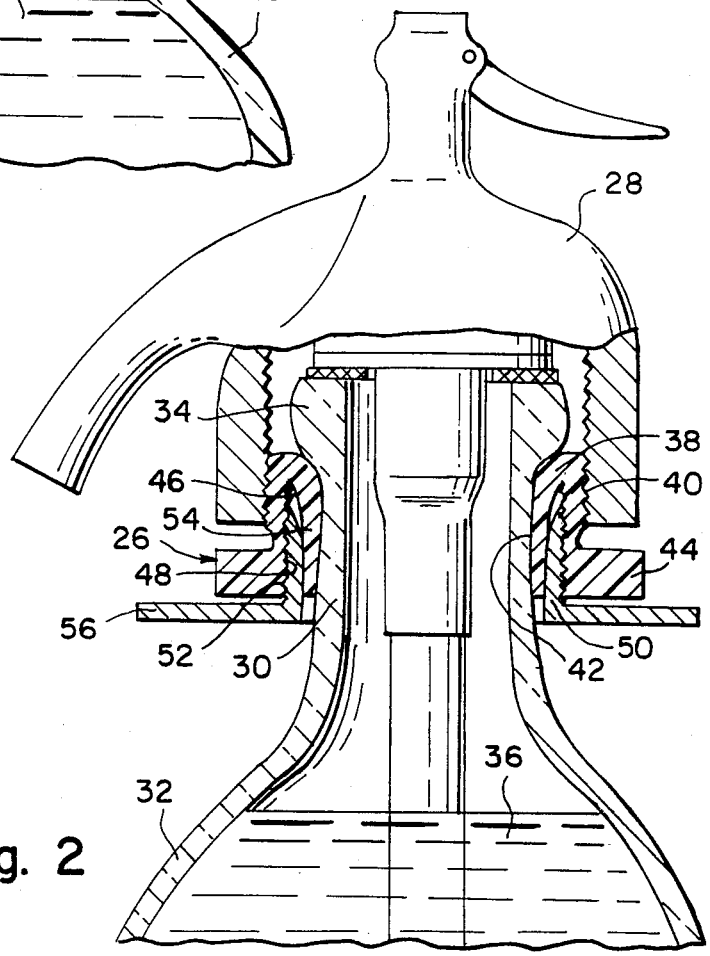
FIG. 2 is a longitudinal section view with parts in elevation of a modification of the invention showing a siphon head and adapter having an adjustable and sealing member on a glass bottle neck, or any non-threaded bottle neck.

FIG. 2 shows an adapter 26 for a standard siphon head 28 employed on an unthreaded neck 30 of a bottle 32 that has an annular lip 34, such as a champagne bottle, for dispensing carbonated liquids 36. The adapter 26 consists of a pliable collar 38 that has outer threads 40 for installation into the standard siphon head 28 and an inner pliable annular wall 42 for installation onto the unthreaded neck 30 of the bottle 32 below and engagement with the annular lip 34. The bottle 32 can be emptied of the liquid 36 through the siphon head 28 without further loss of the carbonation.

The collar 38 further contains an annular flange 44 extending outwardly from bottom thereof to aid in manually tightening the collar into the standard siphon head 28 and the unthreaded neck 30 of the bottle 32 up against the annular lip 34 preventing leakage of the carbonation when installed.

The collar 38 further has an annular tapered groove 46 extending upwardly within, with outer annular wall 48 of the groove 46 threaded. A tapered sleeve 50 is provided and has outer threads 52 for installation into the annular tapered groove 46 of the collar 38. The threads 52 engage with the outer annular threaded wall 48 of the groove 46. When the sleeve 50 is threaded within the annular tapered groove 46 inner portion 54 of the collar 38 will move radially inwardly to seal the unthreaded neck 30 to aid in preventing leakage of the carbonation when installed. This allows the collar 38 to be installed on various size unthreaded neck of bottles.

The tapered sleeve 50 further contains an annular flange 56 extending outwardly from bottom thereof to aid in manually tightening the tapered sleeve 50 into the annular tapered groove 46 of the collar 38 preventing leakage of the carbonation when installed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An adapter for a standard siphon head employed on an unthreaded neck of a bottle having an annular lip for dispensing carbonated liquids which comprises a pliable collar having outer threads for installation into said standard siphon head and an inner pliable annular wall for installation onto said unthreaded neck of said bottle below and engagement with said annular lip, in further combination with means between said outer threads and said wall for applying inward sealing pressure against said wall, so that said bottle can be emptied of said liquid through said siphon head without further loss of said carbonation.

2. An adapter as recited in claim 1, further said means comprise:

(a) said collar having an annular tapered groove extending upwardly within, with an outer annular wall of said groove threaded; and (b) a tapered sleeve having outer threads for installation into said annular tapered groove of said collar and in engagement with said outer annular threaded wall of said groove so that when said sleeve is threaded within said annular tapered groove, said collar will move radially inwardly to seal said unthreaded neck to aid in preventing leakage of said carbonation when installed thus allowing said collar to be installed on various siza unthreaded necks of bottles.

3. An adapter as recited in claim 2, wherein said tapered sleeve further comprises an annular flange extending outwardly from bottom thereof to aid in manually tightening said tapered sleeve into said annular tapered groove of said collar preventing leakage of said carbonation when installed.

* * * * *